US011051672B2

(12) United States Patent
Voelker et al.

(10) Patent No.: US 11,051,672 B2
(45) **Date of Patent: *Jul. 6, 2021**

(54) CLEANING HAND MITT WITH SELECTIVELY INVERTABLE SCRUBBING PAD

(71) Applicant: Black Tie Brands, LLC, Miami, FL (US)

(72) Inventors: Scott A. Voelker, Miami, FL (US); Jonathan D. Batchelor, Stockholm (SE)

(73) Assignee: Black Tie Brands, LLC, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/449,331

(22) Filed: Jun. 21, 2019

(65) Prior Publication Data

US 2020/0397208 A1 Dec. 24, 2020

(51) Int. Cl.
*A47L 13/18* (2006.01)
*A47L 13/44* (2006.01)

(52) U.S. Cl.
CPC ..... *A47L 13/18* (2013.01); *A47L 13/44* (2013.01)

(58) Field of Classification Search
CPC ..... A47L 13/18; A47L 13/16; A41D 19/01; A41D 19/002; A41D 19/0075; A41D 19/0013; A41D 19/0017; A47K 7/02
USPC ..... 15/227
See application file for complete search history.

(56) References Cited

U.S. PATENT DOCUMENTS 1,400,655 A * 12/1921 Bohnert ..... A41D 19/01 2/158
4,712,253 A * 12/1987 Chen ..... A41D 19/0017 2/161.8
10,874,280 B1 * 12/2020 Voelker ..... A47L 13/18
2006/0143847 A1 * 7/2006 Vinson ..... A47L 13/16 15/227
2006/0191092 A1 * 8/2006 O'Reilly ..... A47L 13/18 15/227
2007/0192975 A1 * 8/2007 Aseff ..... A47L 13/19 15/104.94

FOREIGN PATENT DOCUMENTS

JP 3162671 U * 9/2010 ..... A47L 13/18

* cited by examiner

*Primary Examiner* — Laura C Guidotti
(74) *Attorney, Agent, or Firm* — Mark C. Johnson; Johnson Dalal

(57) ABSTRACT

A cleaning hand mitt with a selectively invertible scrubbing pad that includes a mitt body having a relatively soft and non-abrasive cleaning surface covering the outer surface of the hand mitt, the hand mitt body having an enclosed cavity shaped and sized to receive a user's hand and a seam configuration defining a tight seam opening defined thereon. Inside of the hand mitt is an invertible pocket coupled to the seam configuration, wherein the invertible pocket is operably configured to be selectively concealed within the enclosed cavity of the hand mitt and selectively removed from the enclosed cavity to expose an abrasive outer surface of the invertible pocket for scrubbing debris and dirt off a user's vehicle.

19 Claims, 5 Drawing Sheets

CLEANING HAND MITT WITH SELECTIVELY INVERTABLE SCRUBBING PAD

FIELD OF THE INVENTION

The present invention relates generally to cleaning mitts, and, more particularly, relates to cleaning hand mitts with abrasive surfaces.

BACKGROUND OF THE INVENTION

Whether it is an automobile, vessel, or other vehicle, many users desire to have their vehicles cleaned. Depending on the size of the vehicle or how and what debris or dirt is deposited on the vehicle, cleaning vehicles can often be a timely and arduous endeavor. To address this issue, known tools have been created to help users clean their vehicles efficiently and effectively. Some of these cleaning tools include specialty sponges, cloth-based materials, or cleaning tools designed to be more easily handled by a user, e.g., cleaning mitts with a cloth surface that may include a plurality of microfiber flanges disposed thereon. These known cleaning tools typically have one or more types of surface textures, which are often soft to avoid scratching or otherwise damaging the paint or surface of a vehicle. These known cleaning tools can damage vehicle finishes when it comes to having different surfaces for both safely cleaning a vehicle surface and removing heavier debris or dirt disposed thereon.

For example, some known cleaning tools include a cleaning mitt or a sponge with a first side of an abrasive surface or material and a second side, opposite the first side, of a soft material. To use these types of cleaning tools, a user is required to flip the sponge or mitt every time the abrasive material is desired to be used because, for example, the sponge or mitt is specially designed for the left or right hand of a user. Additionally, the exposure of the abrasive material on the cleaning tool also prevents the entire sponge or mitt to be used, thereby reducing the effective cleaning surface area of one material on the sponge or mitt. Moreover, when the soft side of the sponge is being used, the abrasive material is known to irritate and/or damage the user's hand that is holding the sponge. Other known cleaning tools have one or more abrasive portions located on the outer surface of the sponge, but they too cause inadvertent scraping of a vehicle's surface which many users find problematic.

Therefore, a need exists to overcome the problems with the prior art as discussed above.

SUMMARY OF THE INVENTION

The invention provides a cleaning hand mitt with a selectively invertible scrubbing pad that overcomes the hereinafore-mentioned disadvantages of the heretofore-known devices and methods of this general type and that is operably configured to effectively and efficiently clean a car and car windows and windshields without damaging the paint or clearcoat thereon, while providing users the ability to remove and target stains, dirt, or other debris with an abrasive and selectively invertible scrubbing pad.

With the foregoing and other objects in view, there is provided, in accordance with the invention, a cleaning hand mitt with a selectively invertible scrubbing pad having a mitt body with a first end defining an enclosed mitt opening, a second end opposing the first end of the mitt body, a mitt body length separating the first and second ends of the mitt body, a first side, a second side opposite the first side of the mitt body, and having a sidewall with an outer surface spanning the mitt body length and an inner surface, opposing the outer surface of the sidewall, enclosing and defining a mitt cavity spatially coupled to the enclosed mitt opening. The mitt body may also include the first and second sides of the mitt body of a cloth or microfiber material, wherein the mitt body has a seam configuration defining a tight seam opening defined thereon. The hand mitt includes an invertible pocket having a first end sewn into the seam configuration, a second end, opposite the first end of the invertible pocket, a pocket length separating the first and second ends of the invertible pocket, an inner surface, and an outer surface, opposing the inner surface of the pocket. The invertible pocket has a recessed configuration along a pocket translation path with the invertible pocket substantially disposed within the mitt cavity and with the outer surface of the invertible pocket of an abrasive surface and defining a pocket cavity spanning the pocket length and a scrubbing configuration inverted with respect to the recessed configuration, disposed at least partially outside of the mitt cavity, and with the inner surface of the invertible pocket defining the pocket cavity.

In accordance with a further feature of the present invention, the mitt body is of a hand shape having a finger receiving portion and a separated thumb receiving portion. Additionally, the seam configuration may be disposed on a distal end of the finger receiving portion of the mitt body.

In accordance with yet another feature of the present invention, the tight seam opening is disposed at the second end of the mitt body. The tight seam opening may also be opposite the enclosed mitt opening.

In accordance with another feature, an embodiment of the present invention includes the invertible pocket having a front side and a rear side, opposite the front side, wherein the abrasive surface of the outer surface of the invertible pocket substantially covers the front side of the invertible pocket and spans the pocket length.

In accordance with an additional feature of the present invention, the abrasive surface of the outer surface of the invertible pocket substantially covers the rear side of the invertible pocket and spans the pocket length. The abrasive surface of the outer surface of the invertible pocket may also be of a mesh configuration and the outer surface of the sidewall of the mitt body of a microfiber material.

In accordance with another feature, an embodiment of the present invention also includes a plurality of spaced-part microfiber flanges substantially covering the outer surface of the sidewall of the mitt body and having a rounded distal end.

In accordance with yet another feature, an embodiment of the present invention also includes the plurality of spaced-part microfiber flanges are disposed in a tightly spaced configuration.

In accordance with a further feature, an embodiment of the present invention also includes the mitt body having a plurality of seam configurations disposed in spaced-apart configurations and each respectively defining a tight seam opening defined thereon, the plurality of seam configurations each respectively having the invertible pocket coupled thereto.

In accordance with yet another feature, an embodiment of the present invention also includes the mitt body having a hook-and-loop fastener formed at the seam configuration, wherein the hook-and-loop fastener is operably configured to selectively open to place the invertible pocket in the scrubbing configuration. Additionally, the mitt body may have the seam configuration is disposed at the second end of the mitt body.

Also in accordance with the present invention, a cleaning hand mitt with a selectively invertible scrubbing pad is disclosed that includes a mitt body of a hand shape having a finger receiving portion and a separated thumb receiving portion, wherein the mitt body has a first end defining an enclosed mitt opening, a second end opposing the first end of the mitt body, a mitt body length separating the first and second ends of the mitt body, a first side, a second side opposite the first side of the mitt body, and a sidewall with an outer surface spanning the mitt body length and an inner surface, opposing the outer surface of the sidewall, enclosing and defining a mitt cavity spatially coupled to the enclosed mitt opening. The first and second sides of the mitt body may be of a cloth material. The mitt body may also define an opening at the second end of the finger receiving portion of the hand shaped mitt body and may have an invertible pocket coupled to the second end of the finger receiving portion of the hand shaped mitt body. The invertible pocket includes a scrubbing configuration along a pocket translation path with the invertible pocket disposed at least partially outside of the mitt cavity and exposing, on an outer surface thereon, an abrasive scrubbing surface and a recessed configuration inverted with respect to the scrubbing configuration, with the invertible pocket having an enclosed pocket sidewall defining a pocket cavity spatially coupled to the opening at the second end of the finger receiving portion and with the invertible pocket substantially disposed within the mitt cavity.

Although the invention is illustrated and described herein as embodied in a cleaning hand mitt with a selectively invertible scrubbing pad, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the hand mitt. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the hand mitt spanning to and from the first and second ends of the mitt body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
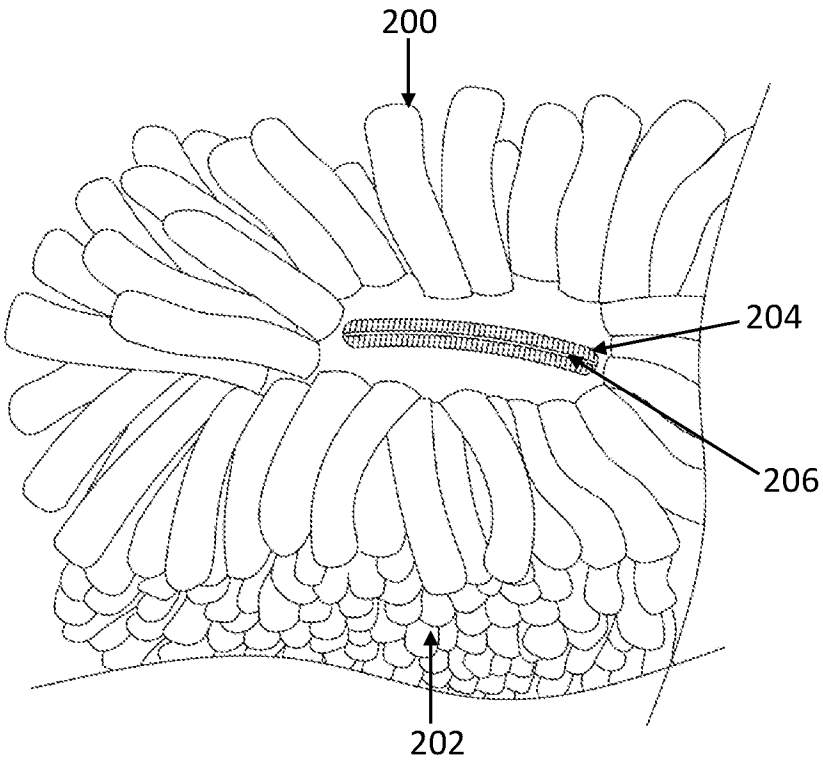
FIG. 2 is a perspective close-up view of the cleaning hand mitt of FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 1:
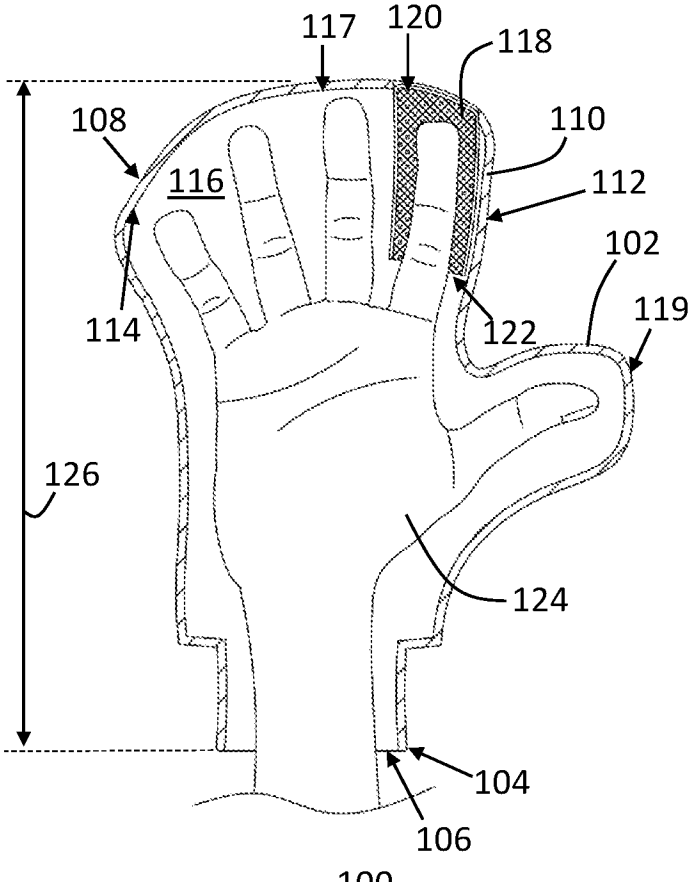
FIG. 1 is a cross-sectional view of a cleaning hand mitt with a user's hand disposed therein and an invertible pocket disposed in a recessed configuration in accordance with one embodiment of the present invention.
Figure 5:
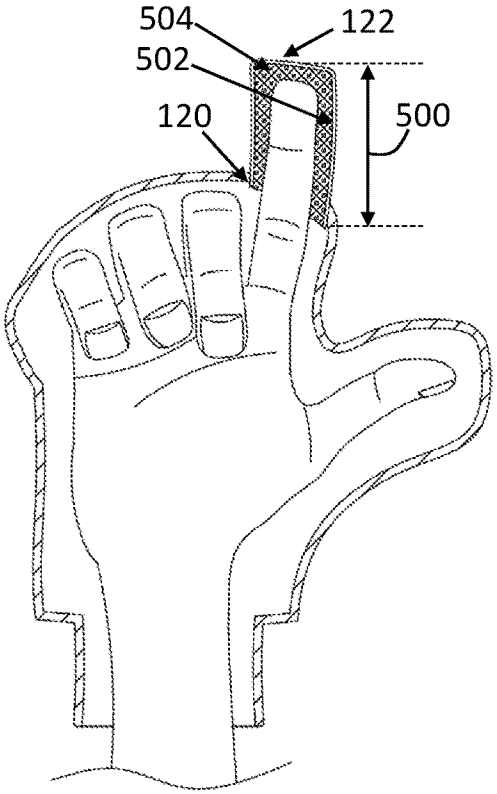
FIG. 5 is a cross-sectional view of a cleaning hand mitt with a user's hand disposed therein and the invertible pocket disposed in a scrubbing configuration in accordance with one embodiment of the present invention.

The present invention provides a novel and efficient cleaning hand mitt having an invertible pocket disposed therein that is operably configured to be selectively recessed within the hand mitt for effectively cleaning a majority of a vehicle's surface with a soft non-abrasive surface of the hand mitt and selectively inverted outside of the hand mitt for scrubbing dirt or debris disposed on the hand mitt. Referring now to FIGS. 1-2 and FIG. 5, one embodiment of the present invention is shown. The figures herein show several advantageous features of the present invention, but, as will be described below, the invention can be provided in several shapes, sizes, combinations of features and components, and varying numbers and functions of the components.

The first example of a cleaning hand mitt 100 with a selectively invertible scrubbing pad includes a mitt body 102 and an invertible pocket 118 coupled thereto and operably configured to be selectively stored or recessed within the mitt body 102 and removed, inverted, and/or turned out for scrubbing. The mitt body 102 includes a first end 104 defining an enclosed mitt opening 106 and a second end 108 opposing the first end 104 of the mitt body 102. The mitt body 102 includes a mitt body length 126 separating the first and second ends 104, 108 of the mitt body 102, wherein the mitt body length 126 ranges from approximately 6-12 inches to enable a user's hand 124 to be inserted within the mitt and effectively clean areas of a user's vehicle.

It should be understood that terms such as, "front," "rear," "side," top," "bottom," and the like are indicated from the reference point of a viewer viewing the mitt 100. As used herein, the term "wall" is intended broadly to encompass continuous structures, as well as, separate structures that are coupled together to form a substantially continuous external surface.

The mitt body 102 also includes a first side 200, a second side 202 opposite the first side 200 of the mitt body 102, and includes a sidewall 110 with an outer surface 112 spanning the mitt body length 126 and an inner surface 114, opposing the outer surface 112 of the sidewall 110. The sidewall 110 may be of a mesh polymeric or cloth lining that is preferably of a material that does irritate a user's skin and resist transportation of a liquid material, i.e. non liquid permeable. The sidewall 110 may enclose and define a mitt cavity 116 for receiving a user's hand. Beneficially, the mitt body 102 may be of a hand shape as shown best in FIG. 1, FIGS. 3-4, and FIG. 6 having a finger receiving portion 117 and a separated thumb receiving portion 119. In other embodiments, the finger receiving portion 117 may be defined by individual finger portions shaped and sized to receive individual fingers of a user. In other embodiments, the finger receiving portion 117 may define a cavity for receiving a plurality of a user's fingers, e.g., four fingers. The separated thumb receiving portion 119 allows the user to effectively grab and maneuver the mitt's outer cleaning surface 112 much better than with a mitt not having a thumb portion 119. Said another way, it is easier to articulate and to grab and clean behind the spokes, door, handles, front grills, corners, etc. of a vehicle with a thumb.

Beneficially, the first and second sides 200, 202 of the mitt body 102 are of a cloth material, e.g., microfiber or other fabric and/or yarn material. Said another way, the outer surface 112 may be of a soft non-abrasive surface material such as sponge, cotton, microfiber, natural sheepskin, wool, etc. suitable for safe and gentle cleaning of a vehicle's surface. In one embodiment, substantially all of the outer surface 112 of the mitt body 102 may be of a soft non-abrasive material and surface spanning the mitt length 126, including both sides 200, 202 of the mitt body 102 and on the finger receiving portion 117 and a separated thumb receiving portion 119 to provide a mitt that is effectively ambidextrous for users. Preferably, however, the outer surface 112 of the sidewall 110 of the mitt body 102 is of a microfiber material, e.g., chenille microfiber.

In one embodiment, the first end 104 may be defined by an elastic band incorporated into and/or coupled to the sidewall, thereby providing compression against the user's wrist and/or arm when the user's hand is inserted within the cavity 116. Therefore, the enclosed mitt opening 106 may be defined by the elastic band and is spatially coupled to the cavity 116. In other embodiments, the first end 104 may be defined by the liner/sidewall 110.

Figure 4:
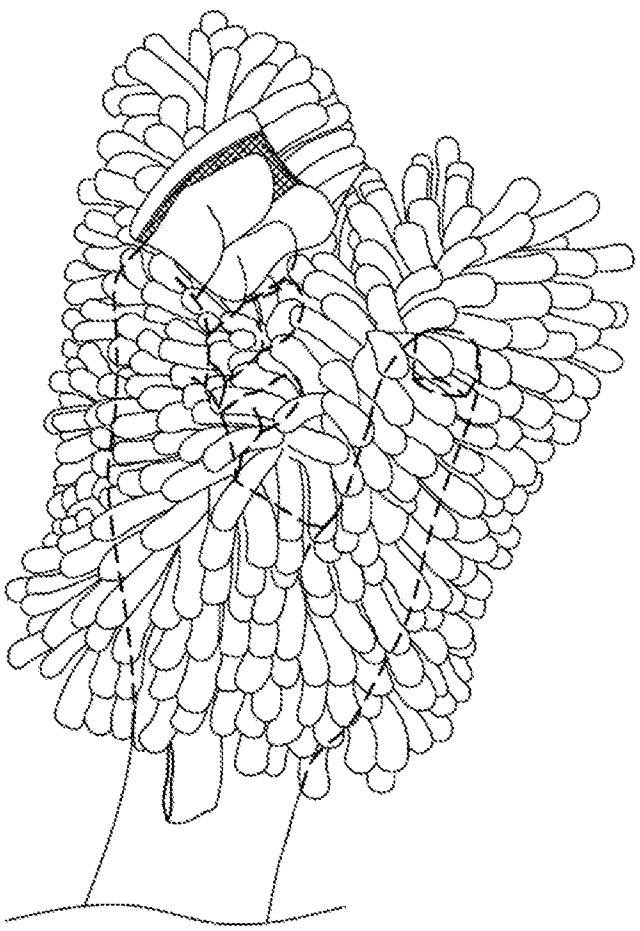
FIG. 4 is another elevational side and partially transparent view of the cleaning hand mitt with a user's hand disposed therein.
Figure 3:
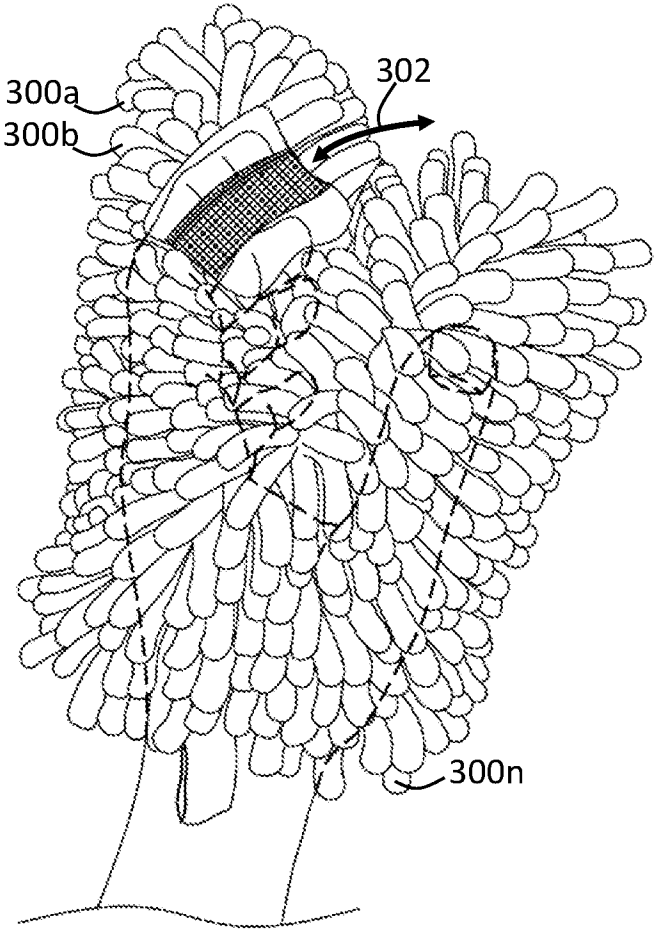
FIG. 3 is an elevational side and partially transparent view of the cleaning hand mitt with a user's hand disposed therein.
Figure 7:
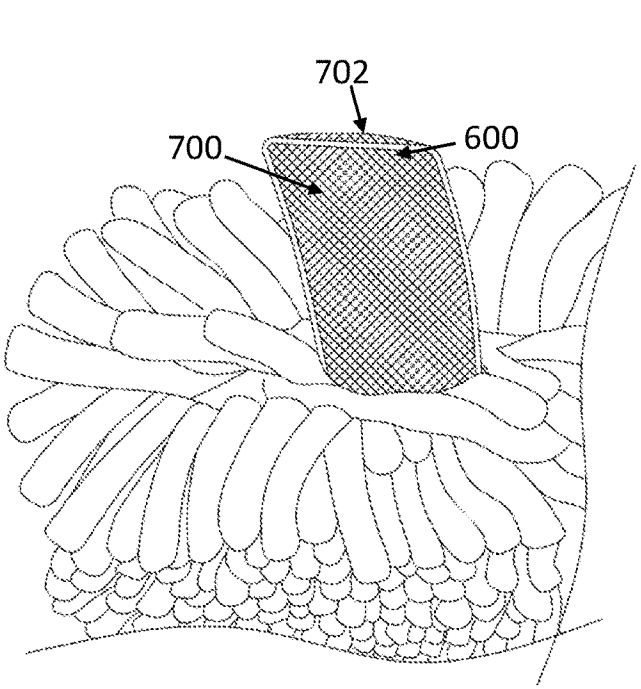
FIG. 7 is a perspective close-up view of the cleaning hand mitt of FIG. 6.
Figure 6:
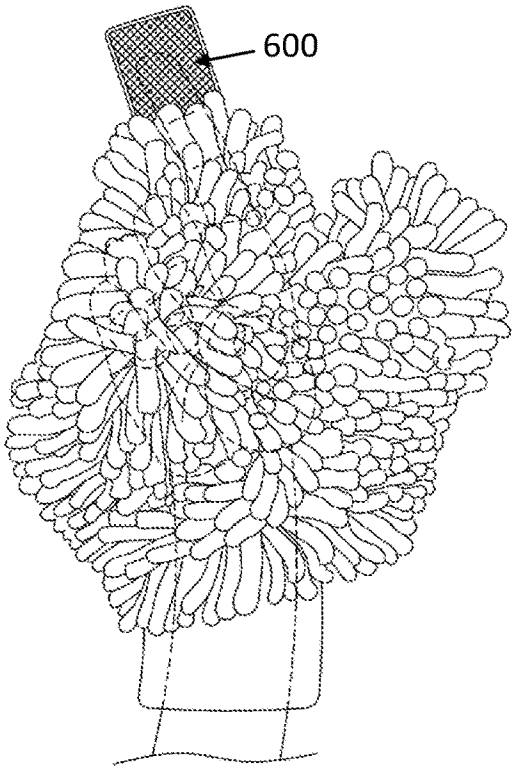
FIG. 6 an elevational front and partially transparent view of the cleaning hand mitt with a user's hand disposed therein.

In one embodiment, the outer surface 112 of the mitt body 102 may include a plurality of spaced-part microfiber flanges 300*a-n* substantially covering the outer surface 112 of the sidewall 110 of the mitt body 102 (as best depicted in FIGS. 3-4), wherein "n" represents any number greater than one. Said another way, the cloth material may cover at least approximately 50-75% of the mitt body 102, but preferably covers at least approximately 90% of the mitt body 102. Each of the plurality of spaced-part microfiber flanges 300*a-n* may include a rounded distal or terminal end and are operably configured to be flexible. Said another way, the microfiber flanges 300*a-n* may be of a semi obround shape. The microfiber flanges 300*a-n* may be disposed in a tightly spaced configuration, i.e., within approximately 0.25 inches of one another, and are preferably directly adjacent to one another and substantially sharing a border with neighboring flange(s) 300*a-n*.

With reference generally to FIGS. 1-7, in one embodiment, the mitt body 102 includes a seam configuration 204 defining a tight seam opening 206 defined thereon. The seam configuration 204 is formed through a sewn fabric that biases the sidewall 110 of the mitt body 102 such that the seam opening 206 is substantially closed via the hem. Said another way, the tight seam opening 206 is a width less than approximately 0.25-0.5 inches spanning from end-to-end. In one embodiment, the tight seam opening 206 is substantially closed with the sidewall 110, defining the tight seam opening 206, abutting one another. In one embodiment the threading forming the seam configuration 204 may be of an elastic threading configuration. In another embodiment, one or more fastener(s) may be utilized to selectively open and close eject or receive the invertible pocket 118, while minimizing the receipt of water, soap, or other liquid from entering a pocket cavity 504 defined by the inner surface 502 of the pocket 118 when in the recessed configuration (shown best in FIG. 1). The fastener(s) also prevents the pocket 118 from inadvertently being turned out or removed from the mitt body 102.

The invertible pocket 118 includes a first end 120 that may be sewn into or otherwise coupled to the seam configuration 204. The pocket 118 also includes a second end 122 opposite the first end 120 of the invertible pocket 118 and a pocket length 500 separating the first and second ends 120, 122 of the invertible pocket 118. The pocket length 500 may be the length of, or greater than, a user's finger, e.g., approximately 3-6 inches. The second end 122 is free, i.e., it is directly uncoupled to any structure. Additionally, invertible pocket 118 is beneficially enclosed on its sides and at the second end 122 to define a pocket cavity 504 is operable configured to be selectively inverted by the user inserting and pushing his or her finger (or multiple fingers) into and on the inner surface 502 at the second end 122 of the pocket 118.

More specifically, the invertible pocket 118 includes an inner surface 502 and an outer surface 600, opposing the inner surface 502 of the pocket 118. As discussed above, the invertible pocket 118 is operable to have a recessed or retracted configuration (as best seen FIG. 1) along a pocket translation path (represented and exemplified with arrow 302 in FIG. 3) and a scrubbing configuration (as best seen FIGS. 5-7) along the pocket translation path 302. When in the recessed or retracted configuration, the invertible pocket 118 is substantially disposed within the mitt cavity 116 and has the outer surface 600 defining a pocket cavity 504 spanning the pocket length 500. Said another way, the first end 120 of the invertible pocket 118 is sewn, adhesively attached, or otherwise coupled to the mitt body 102, wherein the pocket 118 hangs downwardly into the mitt cavity 116 where a user can place it in front of or behind his or her finger (as best seen in FIGS. 3-4, respectively) until it is desired to be used.

The invertible pocket 118 outer surface 600, which defines the pocket cavity 504 when in the recessed configuration, is beneficially of an abrasive material and/or surface configured to create a surface conducive to remove hard to remove dirt or debris from a vehicle's surface, yet not damage the same. Some examples include a flexible and soft rubber or silicone material having a hardness of approximately 40-60 Shore A, a polymeric wire mesh material, a polymeric mesh configuration (as shown best in FIG. 7) or solid material configured with ridges, and/or a ceramic material. The aforementioned abrasive surface of the invertible pocket 118 is, however, preferably more abrasive than the material and/or surface of a majority of the mitt body 102 (which is used for cleaning the majority of the vehicle's surface).

The scrubbing configuration (shown best in FIGS. 5-7) of the invertible pocket 118 is inverted with respect to the recessed configuration of the pocket 118 to expose the abrasive material and/or surface. Said another way, the scrubbing configuration includes the invertible pocket 118 disposed at least partially outside of the mitt cavity 116 and with the inner surface 502 of the invertible pocket 118 now defining the pocket cavity 504. The invertible pocket 118, which may be sewn or coupled together from two pieces of material, also includes a front side 700 and a rear side 702, opposite the front side 700, wherein the abrasive surface of the outer surface 600 of the invertible pocket 118 substantially covers the front side 700 of the invertible pocket 118 and spans the pocket length 500. In other embodiments, the abrasive surface of the outer surface 600 of the invertible pocket 118 also substantially covers the rear side 702 of the invertible pocket 118 and spans the pocket length 500, thereby providing versatility to ambidextrous users. The invertible pocket 118 may also be of a singular woven pocket or formed, molded of a polymeric material such as silicone and into one piece, and/or a combination of the above.

Figure 9:
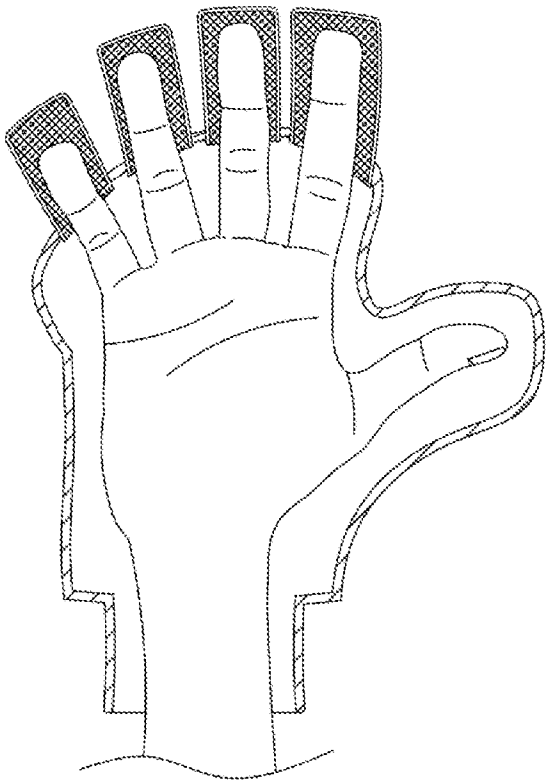
FIG. 9 is a cross-sectional view of the cleaning hand mitt of FIG. 8 with the user's hand disposed therein and the plurality of invertible pocket disposed in a scrubbing configuration in accordance with one embodiment of the present invention.
Figure 8:
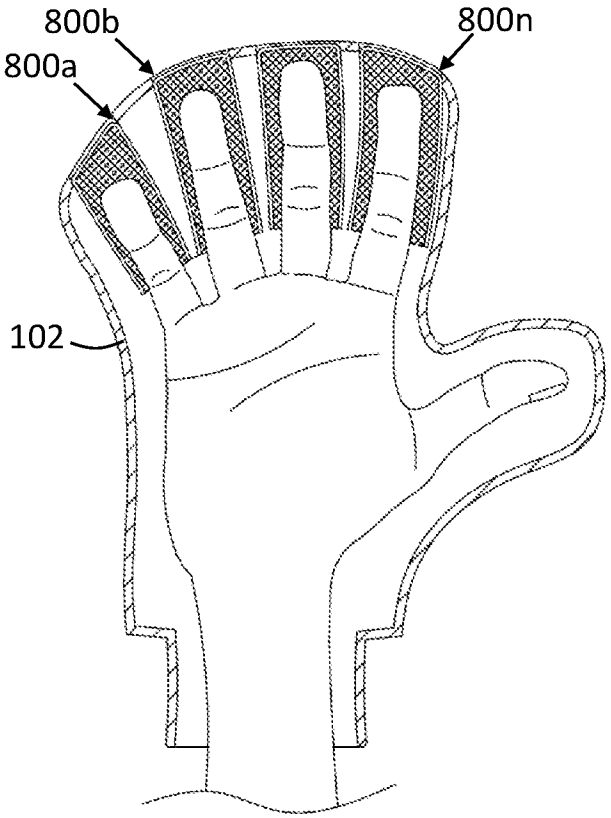
FIG. 8 is a cross-sectional view of a cleaning hand mitt with a user's hand disposed therein and a plurality of invertible pocket disposed in a recessed configuration in accordance with one embodiment of the present invention.
Figure 11:
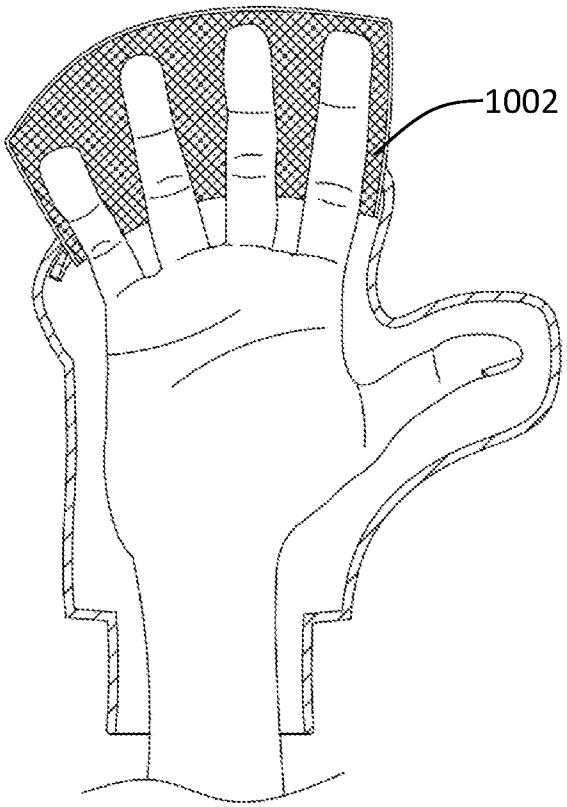
FIG. 11 is a cross-sectional view of the cleaning hand mitt of FIG. 10 with the user's hand disposed therein and the invertible pocket disposed in a scrubbing configuration in accordance with one embodiment of the present invention.
Figure 10:
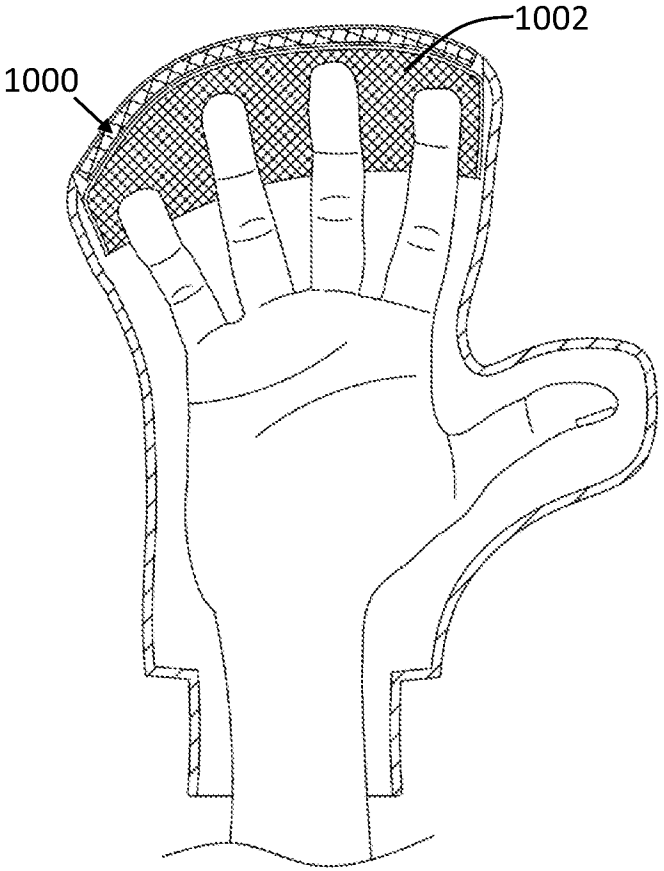
FIG. 10 is a cross-sectional view of a cleaning hand mitt with a user's hand disposed therein and an invertible pocket disposed in a recessed configuration in accordance with one embodiment of the present invention.

While one embodiment of the invertible pocket 118 is shown in FIGS. 1-7, other embodiments of the present invention include the mitt 100 having different pocket configurations. Specifically, as shown in FIGS. 8-9, the mitt body 102 may include a plurality of seam configurations 800*a-n* disposed in spaced-apart configuration (e.g., approximately 0.5-1 inches) and each respectively defining a tight seam opening defined thereon (similar to what has been discussed above). The plurality of seam configurations 800*a-n* each respectively may have the invertible pocket 118 coupled thereto. As shown in FIGS. 10-11, a hook-and-loop fastener 1000 may be formed at a seam configuration 204. In said embodiment, the hook-and-loop fastener 1000 may be operably configured to selectively open to place an invertible pocket 1002 in a recess configuration (FIG. 10) and a scrubbing configuration (FIG. 11). The invertible pocket 1002, as shown in FIGS. 10-11, is shaped and sized to receive four fingers of a user, thereby providing a greater abrasive surface area.

Referring back to FIGS. 1-7, the seam configuration 204 and/or opening 206 is disposed and defined on a distal/terminal and/or second end 108 of the mitt body 102 to effectively invert the invertible pocket 118 to a usable and effective position. In other embodiments, the seam configuration 204 and/or opening 206 is disposed and defined on a distal end 108 of the finger receiving portion 117 of the mitt body 102. In further embodiments, the seam configuration 204 and/or opening 206 is disposed and defined on a distal end 108 of the separated thumb receiving portion 118 of the mitt body 102. Said different, the seam configuration 204 and/or opening 206 may also be disposed opposite the enclosed mitt opening 106. As shown best in FIG. 2, the mitt body 102 may include the softer material or surface surrounding the perimeter of the seam configuration 204 and/or opening 206.

Therefore, a cleaning hand mitt has been disclosed that is operably configured to safely and effectively clean all painted and coated surfaces of a vehicle without scratching the same. At the same time, the mitt 100 is also configured with a built-in concealed scrub finger operably configured to clean hard-to-remove items, dirt, debris, etc. from the surface(s) of vehicles, including windows and windshields, without causing damage to said vehicle surface(s). When not desired for use, the scrubbing finger is configured to retract into the mitt cavity 116 or interior of the mitt body 102 when not in use. The hand shape depicted in the figures also allows better cleaning surface articulation and eliminates rolling of the mitt upon a user's hand when wiping large surfaces of a vehicle. Regardless the vehicle or other surface desired to be cleaned, the mitt 100 provides users a fast, effective, efficient and safe vehicle cleaning tool body and wheels with the least amount of effort, time, and tools. Said another way, the mitt provides versatility for users in that has both a gentle cleaning surface and a concealable and removable abrasive cleaning surface. Unlike known cleaning tools, the abrasive invertible pocket is selectively exposed only when needed, thereby minimizing or eliminating scratching of a car surface or finish and providing a mitt that safely cleans, scrubs harder, and does not damage paint surfaces.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features. Moreover, although a specific order of executing the process herein has been disclosed, the order of executing the steps may be changed relative to the order shown in certain embodiments. Also, two or more steps shown in succession may be executed concurrently or with partial concurrence in some embodiments. Certain steps may also be omitted for the sake of brevity. In some embodiments, some or all of the process steps can be combined into a single process.

What is claimed is:

1. A cleaning hand mitt with a selectively invertible scrubbing pad comprising:

a mitt body having a first end defining an enclosed mitt opening, a second end opposing the first end of the mitt body, a mitt body length separating the first and second ends of the mitt body, a first side, a second side opposite the first side of the mitt body, and having a sidewall with an outer surface spanning the mitt body length and an inner surface, opposing the outer surface of the sidewall, enclosing and defining a mitt cavity spatially coupled to the enclosed mitt opening, the mitt body having a seam configuration defining a tight seam opening defined thereon; and an invertible pocket having a first end sewn into the seam configuration, a second end, opposite the first end of the invertible pocket, a pocket length separating the first and second ends of the invertible pocket, an inner surface, and an outer surface, opposing the inner surface of the pocket, the invertible pocket having a recessed configuration along a pocket translation path with the invertible pocket substantially disposed within the mitt cavity and with the outer surface of the invertible pocket of an abrasive surface and defining a pocket cavity spanning the pocket length and a scrubbing configuration inverted with respect to the recessed configuration, disposed at least partially outside of the mitt cavity, and with the inner surface of the invertible pocket defining the pocket cavity.

2. The hand cleaning mitt according to claim 1, wherein: the mitt body is of a hand shape having a finger receiving portion and a separated thumb receiving portion.

3. The cleaning hand mitt according to claim 1, wherein: the seam configuration is disposed on a distal end of the finger receiving portion of the mitt body.

4. The cleaning hand mitt according to claim 1, wherein: the tight seam opening is disposed at the second end of the mitt body.

5. The cleaning hand mitt according to claim 4, wherein: the tight seam opening is opposite the enclosed mitt opening.

6. The cleaning hand mitt according to claim 1, wherein the invertible pocket further comprises:

a front side and a rear side, opposite the front side, wherein the abrasive surface of the outer surface of the invertible pocket substantially covers the front side of the invertible pocket and spans the pocket length.

7. The cleaning hand mitt according to claim 6, wherein: the abrasive surface of the outer surface of the invertible pocket substantially covers the rear side of the invertible pocket and spans the pocket length.

8. The cleaning hand mitt according to claim 7, wherein: the abrasive surface of the outer surface of the invertible pocket is of a mesh configuration and the outer surface of the sidewall of the mitt body of a microfiber material.

9. The cleaning hand mitt according to claim 7, further comprising:

a plurality of spaced-part microfiber flanges substantially covering the outer surface of the sidewall of the mitt body and having a rounded distal end.

10. The cleaning hand mitt according to claim 9, wherein: the plurality of spaced-part microfiber flanges are disposed in a tightly spaced configuration.

11. The cleaning hand mitt according to claim 1, wherein the mitt body further comprises:

a plurality of seam configurations disposed in spaced-apart configuration and each respectively defining a tight seam opening defined thereon, the plurality of seam configurations each respectively having the invertible pocket coupled thereto.

12. The cleaning hand mitt according to claim 1, wherein the mitt body further comprises:

a hook-and-loop fastener formed at the seam configuration, the hook-and-loop fastener operably configured to selectively open to place the invertible pocket in the scrubbing configuration.

13. The cleaning hand mitt according to claim 12, wherein the mitt body further comprises:

the seam configuration is disposed at the second end of the mitt body.

14. A cleaning hand mitt with a selectively invertible scrubbing pad comprising:

a mitt body:

of a hand shape having a finger receiving portion and a separated thumb receiving portion;

having a first end defining an enclosed mitt opening, a second end opposing the first end of the mitt body, a mitt body length separating the first and second ends of the mitt body, a first side, a second side opposite the first side of the mitt body, and having a sidewall with an outer surface spanning the mitt body length and an inner surface, opposing the outer surface of the sidewall, enclosing and defining a mitt cavity spatially coupled to the enclosed mitt opening; and defining an opening at the second end of the finger receiving portion of the hand shaped mitt body; and an invertible pocket coupled to the second end of the finger receiving portion of the hand shaped mitt body, having:

a scrubbing configuration along a pocket translation path with the invertible pocket disposed at least partially outside of the mitt cavity and exposing, on an outer surface thereon, an abrasive scrubbing surface; and a recessed configuration inverted with respect to the scrubbing configuration, with the invertible pocket having an enclosed pocket sidewall defining a pocket cavity spatially coupled to the opening at the second end of the finger receiving portion and with the invertible pocket substantially disposed within the mitt cavity.

15. The cleaning hand mitt according to claim 14, wherein the mitt body further comprises:

a seam configuration defining the opening at the second end of the finger receiving portion of the hand shaped mitt body, wherein the opening at the second end of the finger receiving portion of the hand shaped mitt body is of a tight seam opening.

16. The cleaning hand mitt according to claim 15, wherein the invertible pocket further comprises:

a first end sewn into the seam configuration, a second end, opposite the first end of the invertible pocket, a pocket length separating the first and second ends of the invertible pocket, and an inner surface opposing the outer surface of the pocket, wherein the recessed configuration includes the outer surface of the invertible pocket defining the pocket cavity spanning the pocket length and the scrubbing configuration includes the inner surface of the invertible pocket defining the pocket cavity.

17. The cleaning hand mitt according to claim 16, wherein the invertible pocket further comprises:

a front side and a rear side, opposite the front side, wherein the abrasive surface of the outer surface of the invertible pocket substantially covers the front side of the invertible pocket and spans the pocket length.

18. The cleaning hand mitt according to claim 17, wherein:

the abrasive surface of the outer surface of the invertible pocket substantially covers the rear side of the invertible pocket and spans the pocket length.

19. The cleaning hand mitt according to claim 18, wherein:

the abrasive surface of the outer surface of the invertible pocket is of a mesh configuration and the outer surface of the sidewall of the mitt body of a microfiber material.

* * * * *